United States Patent [19]

Heller et al.

[11] Patent Number: 4,659,398

[45] Date of Patent: Apr. 21, 1987

[54] METHOD FOR REDUCING INTERNAL STRESSES OF ROLLER STRAIGHTENED RAILS

[75] Inventors: Wilhelm Heller, Duisburg; Lutz Weber, Mühlheim; Reinhard Schweitzer, Düsseldorf; Jürgen Flügge, Duisburg, all of Fed. Rep. of Germany

[73] Assignee: Krupp Stahl Aktiengesellschaft, Bochum, Fed. Rep. of Germany

[21] Appl. No.: 818,837

[22] Filed: Jan. 14, 1986

[30] Foreign Application Priority Data

Jan. 18, 1985 [DE] Fed. Rep. of Germany ..... 3501522
Jan. 18, 1985 [DE] Fed. Rep. of Germany ..... 3501523

[51] Int. Cl.[4] ..... C21D 1/00; C21D 6/00; B21B 1/08; B21D 3/02

[52] U.S. Cl. ..... 148/12 R; 72/128; 72/200; 148/134; 420/8

[58] Field of Search ..... 72/128, 200, 202, 342, 72/364; 148/12 R, 36, 39, 148, 152, 12 B, 134

[56] References Cited

U.S. PATENT DOCUMENTS

| | | | |
|---|---|---|---|
| 1,285,749 | 11/1918 | Lewis et al. | 148/36 |
| 1,331,175 | 2/1920 | Wills | 148/36 |
| 1,363,601 | 12/1920 | Kenney | 72/200 |
| 1,914,439 | 6/1933 | Langford | 72/128 X |
| 4,082,577 | 4/1978 | Heller | 148/36 X |
| 4,486,248 | 12/1984 | Ackert et al. | 148/152 X |
| 4,575,397 | 3/1986 | Heller | 148/39 X |

*Primary Examiner*—E. Michael Combs
*Attorney, Agent, or Firm*—Sprung Horn Kramer & Woods

[57] ABSTRACT

The present invention relates to a process for reducing internal stresses of roller straightened rails. After the straightening operation the rail web portion is heated for a short time to temperatures ranging between 200°-700° C., preferably between 350°-500° C., and after reaching the desired temperatures the rail is cooled by air to room temperature. For the purpose of heating the rail is continuously conveyed in front of the heating apparatus.

The inventive process permits to reduce internal stresses in the rail head and base portions to a value of less than 50 N/mm$^2$ thus ensuring increased rupture strength of the rail.

6 Claims, 8 Drawing Figures

METHOD FOR REDUCING INTERNAL STRESSES OF ROLLER STRAIGHTENED RAILS

BACKGROUND OF THE INVENTION

After the rolling operation rails produced by hot rolling of rail steel in appropriately calibrated rolls are cooled by air on cooling beds to room temperature. Nevertheless, due to different ratios of mass to surface in the rail head and rail base the rails are deformed during cooling. Consequently, in order to respect straightness requirements, these rails have to be straightened on a roll straightener and, if necessary, restraightened by means of a gag press (German handbook "Die Eisenbahnschiene" by Fritz Fastenrath, editors Wilhelm Ernst & Son, 1977, pages 113/114).

During roller straightening the total rail section is plastically deformed. But as over the total rail section these deformations have different values, there are caused internal stresses in the straightened rails. At the tread surface and at the lower surface of the rail base, which are submitted to the highest loads during operation, these internal stresses are positive in the longitudinal direction, i.e. there exist internal tension stresses (cf. page 37 of the above cited handbook).

Said internal stresses may reach up to 50% and more of the rail yield strength.

During operation these stresses are superposed by flexural tensile stresses caused by the wheels, and longitudinal tension stresses caused by cooling and contraction of the rails at low temperatures. Consequently, the internal tension stresses existing in the rails reduce the rupture strength of the rails in case of surface flaws, such as for instance fatigue cracks due to static or dynamic strains (Technische Mitteilungen Krupp, Werksberichte 39 (1981), pages 33 to 44).

In order to reduce internal tension stresses in the rail head and base portions, the rails may be stretch-straightened (DE-OS No. 32 23 346) or controllably cooled and laterally straightened (DE-PS No. 19 42 929). But these processes comprise technical difficulties (stretch-straightening), and in certain cases the straightness required for high speed public transport is not precisely adjustable (stretch-straightening, controlled cooling in connection with lateral straightening) so that for reasons of economy and practicability these processes were not successful.

A further process for reducing internal tension stresses in the rail head and base portions in a normalizing operation.

According to the technical measures for reducing internal stresses through normalizing at increased temperatures, described by Houdremont in "Handbuch der Sonderstahlkunde" editors Springer-Verlag 1956, pages 238–240, said process is a heat treatment by annealing the rails at a temperature ranging from about 200°–700° C. comprising subsequent slow cooling. Since the decomposition of internal stresses is caused by a flow process starting at higher temperatures and discharging the rail material, reduction of internal stresses to low residual values of about 20–60 N/mm$^2$ is only ensured through a period of time sufficient for the operational sequence of the flow processes. For this reason, the annealing treatment of rails requires in practice a duration of several hours. Citation "Technische Mitteilungen Krupp", Company Reports 39 (1981), page 33, indicates a treatment duration of six hours at a temperature of 550° C.

It is therefore an object of the present invention to suggest an efficient and uncostly heat treatment process for reducing internal stresses in the head and base portions of roller straightened rails, which may be integrated into the usual production cycle of rails.

SUMMARY OF THE INVENTION

Said object is solved by the fact that the rails are continuously conveyed on a rolling path in front of a heating apparatus at a speed ranging between 0.2 m/min and 1 m/s, and that during the corresponding rail conveying cycle of 1 to 300 s/m only the rail web portion is heated to annealing temperature, and that after reaching this temperature the rail is cooled to room temperature.

The heating of the rail web portion may be accomplished by means of burners or by means of an inductive process.

The conveying speed of the rails in front of the heating device depends on the capacity of the chosen heating apparatus.

The inventive process, in which, contrary to prior normalizing processes, the rails are not heated over the total section but only in the web portion, permits a very short time and therefore uncostly rail treatment duration. Provided the heating apparatus capacity is sufficient, this permits to heat-treat for instance a 30 m long rail in only 30 seconds, while the time necessary for normalizing takes several hours.

DETAILED DESCRIPTION OF THE INVENTION

Figure 1:
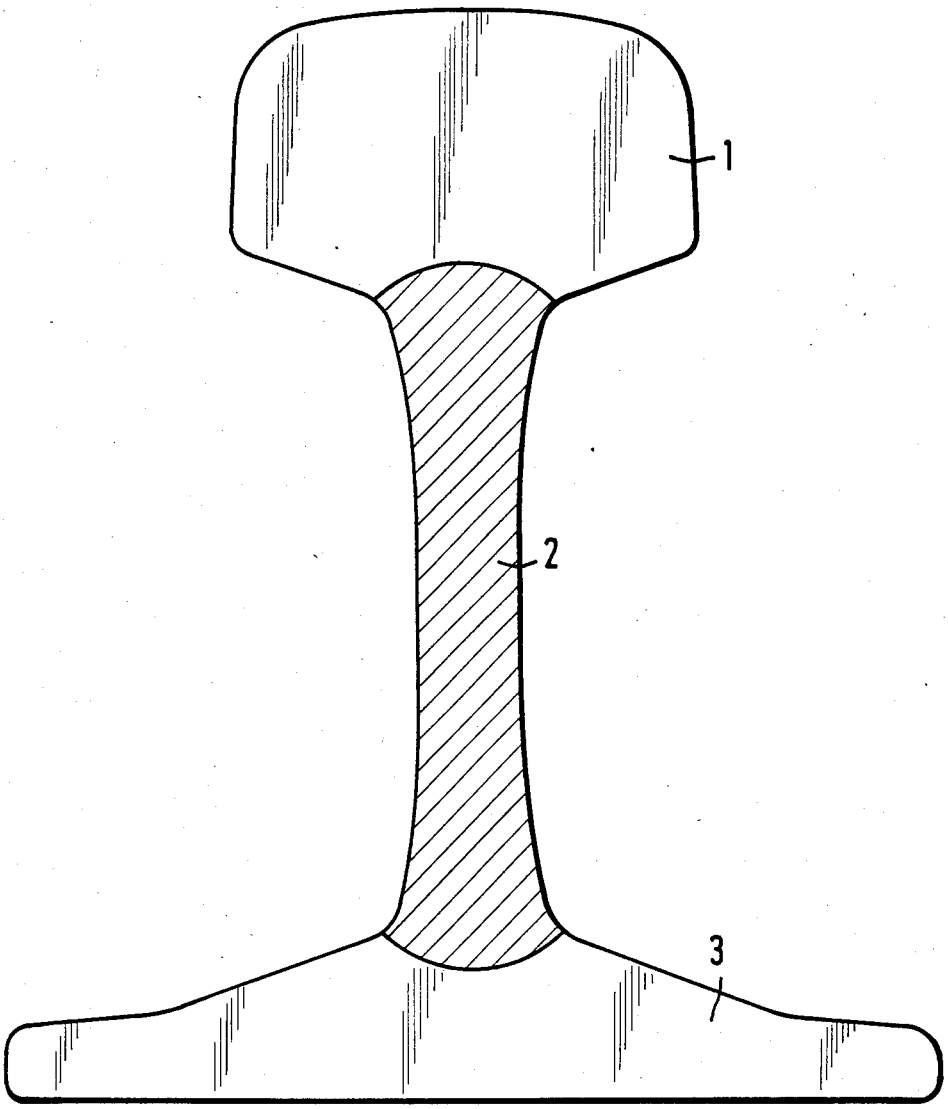
FIG. 1 is an elevational view of a rail section.

It has been found that after performing the inventive heat treatment process internal stresses at the tread face and the lower base face are substantially eliminated. The table hereafter indicates as example the internal stresses of a high-strength UIC 60 rail having a tensile strength of 1,230 N/mm$^2$ (0.72% of C, 0.70% of Si, 1.1% of Mn, 0.94% of Cr, 0.12% of V, 0.025% of Al) in roller straightened condition and after additional heating of the web portion to 300°, 400°, 500° or 680° C. FIG. 1 shows a scaled view of said rail section comprising head portion 1, heatable web portion 2 and base portion 3.

TABLE

Internal stresses of a UIC 60 rail, grade S 1200

| | longitudinal internal stresses in N/mm$^2$ | |
|---|---|---|
| Treating condition | tread surface | lower base surface |
| roller straightened | +211 | +259 |

TABLE-continued

| Internal stresses of a UIC 60 rail, grade S 1200 | | |
|---|---|---|
| | longitudinal internal stresses in N/mm² | |
| Treating condition | tread surface | lower base surface |
| without subsequent web portion heating | | |
| roller straightened and web portion heating to 300° C. | +153 | +15 |
| roller straightened and web portion heating to 400° C. | +38 | +40 |
| roller straightened and web portion heating to 500° C. | −21 | +21 |
| roller straightened and web portion heating to 680° C. | −42 | +49 |

(+) = tensile stress
(−) = compressive stress

It appears that longitudinal internal stresses are reduced through web portion heating to values of less than 50 N/mm². At higher heating temperatures occur at the tread face even slight internal compression stresses. When heated to a temperature of 300° C. the decomposition of internal stresses at the tead surface is still incomplete.

The decomposition of internal rail stresses permits to obtain a substantial improvement of rupture strength. This relationship was confirmed by rails heat-treated according to the invention. Rail sections provided with a transverse notch in the base portion have been tested for this purpose in a test arrangement as described in "Technische Mitteilungen Krupp", Company Reports 39 (1981), pages 33 to 44. The rail section heat-treated according to the present invention and therefore substantially free of internal stresses broke under an external load of 200 N/mm² by a fatigue crack of about 10 mm depth, while in the roller straightened reference rail rupture occured already at a crack depth of about 2 mm. Consequently, for the same loads the rail heat-treated according to the present invention withstands a much deeper crack than the roller straightened reference rail. This means that the rail heat-treated according to the present invention presents a considerably higher rupture strength.

The brittle rupture strength of a material is characterized by its crack resistance.

Crack resistance is a material data indicating the conditions of instable crack growth (brittle fracture) as a function of stresses and crack size. As explained in the above citation it is admissible to apply the law of linear elastic fracture mechanics to rails, and to quantitatively deduct therefrom brittle fracture conditions. Nevertheless, the calculations have to take into account internal stresses.

The relation is the following:

$$\sigma = \frac{K_{Ic}}{\sqrt{M} \cdot \sqrt{t}}.$$

Therein δ indicates the stress (N/mm²), $K_{Ic}$ the crack resistance in N/mm$^{3/2}$, M a geometry factor and t the crack depth (mm).

Figure 2:
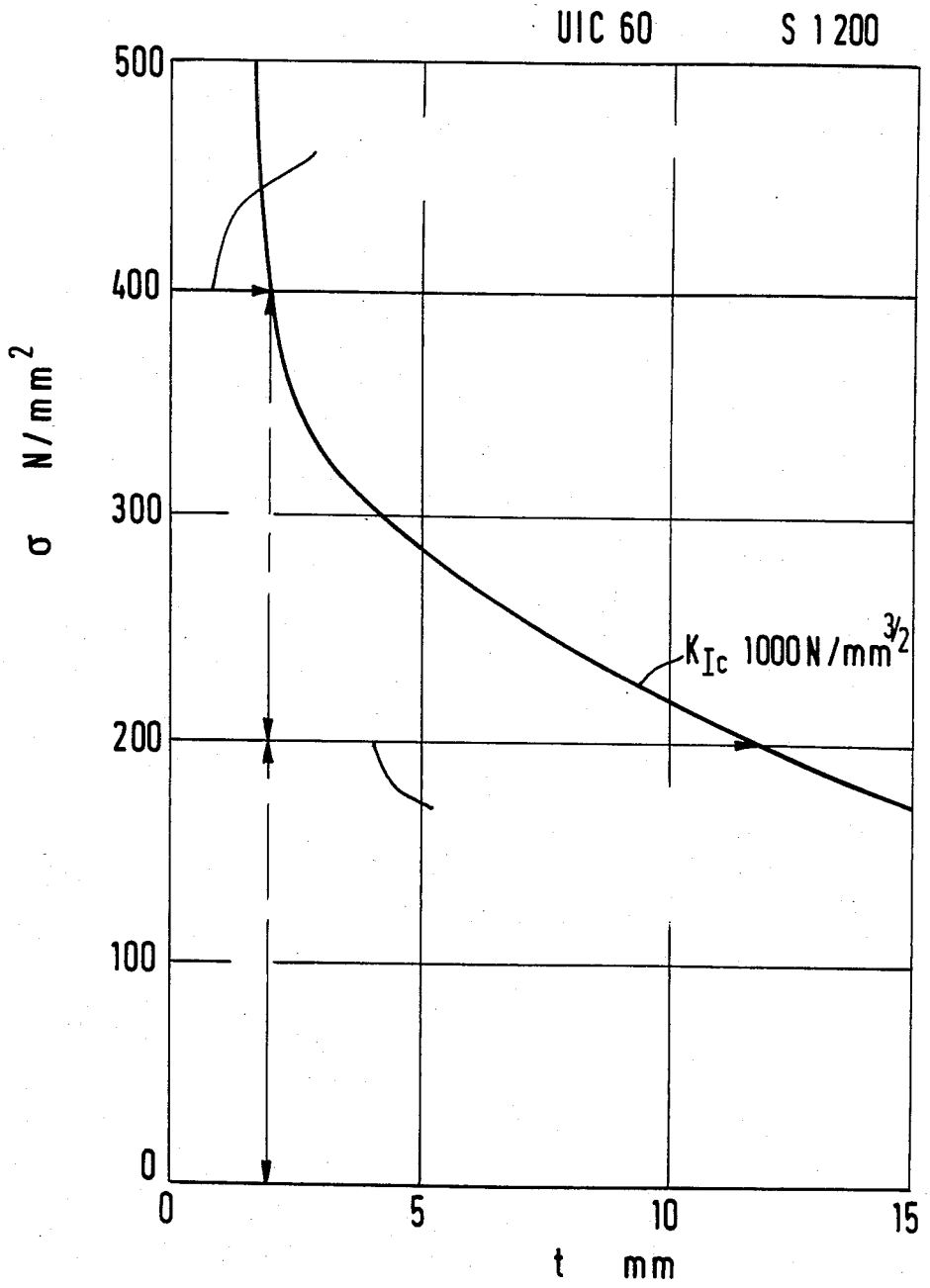
FIG. 2 is a graph of tensile strength vs. depth for a UIC rail.

For explaining the influence of internal stresses FIG. 2 shows for the UIC 60 rail having a tensile strength of 1230 N/mm² the relationship between stresses and crack depth, with the crack resistance as parameter. For a crack resistance of 1,000 N/mm$^{3/2}$ a rail free of internal stresses will withstand under an external load of 200 N/mm² a crack having a depth of about 10 mm. However, a rail comprising internal stresses of 200 N/mm² will fail under identical external loads already at a crack depth of about 2 mm. The rail free of internal stresses presents considerably higher rupture strength since small cracks or notches do not yet cause failure. On the other hand it is possible to detect sufficiently early by means of non-destructive inspections larger flaws so that rail failure may be avoided.

Figure 3:
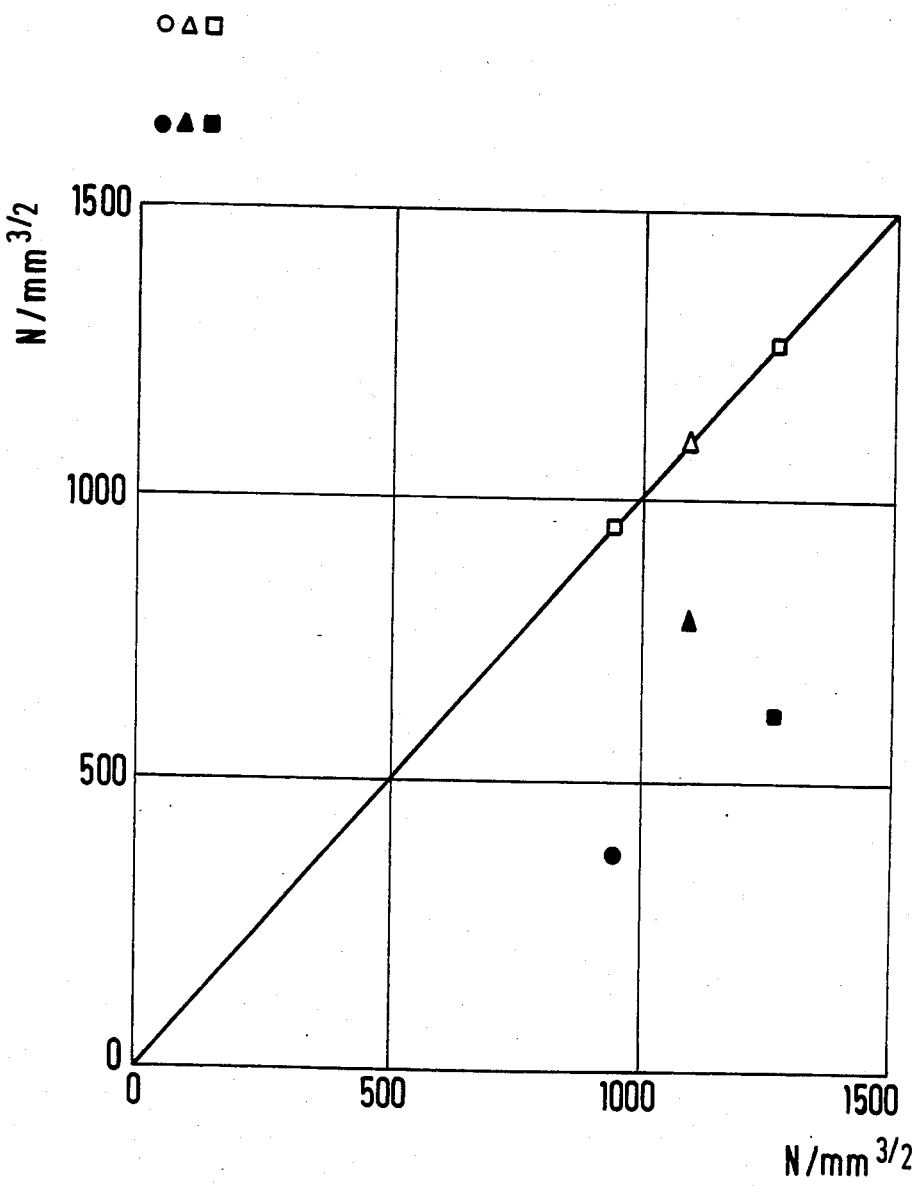
FIG. 3 is a graph relating to crack peak and crack resistance.

If the rail is considered as component and if internal stresses are considered as a value reducing the critical stress intensity at the crack peak (=crack resistance of the component) there is obtained the scheme represented in FIG. 3. The crack resistance $K_I$ of the rail component is plotted over the crack resistance $K_{Ic}$ of the rail steel. The critical value $K_I$ represents a value for the rupture strength of the rail. In the case of rails free of internal stresses treated according to the inventive process, the values are grouped around the 45° line. However, in case of rails comprising internal stresses, the critical $K_I$-value clearly ranges below this line.

The inventive process may also be advantageously used for decomposing internal stresses of rolled and then straightened steel sections comprising a web portion and head and/or base portions vertically extending thereto, such as for instance a T-beam or a double T-beam.

The object of the present invention to create an efficient and uncostly process for decomposing internal stresses of roller straightened steel rails, which may be integrated into the usual production line of rails, is also alternatively solved by the fact that before entering the roller straightening machine the rails cooled to a temperature of less than 100° C. after hot rolling, are continuously heated in the web section to a temperature ranging between 100° and 500° C., preferably about 150°-350° C., and that after the straightening operation they are cooled by air to room temperature.

This measure causes compressive pretensions in the rail web reaching almost tensile strength. Roller straightening may be performed with lower forces and leads to more uniform deformations of the total rail section. After the straightening operation the web temperature assimilates to that of the head and base portions. The longitudinal tension stresses in the head and base portions are decomposed and may even be transformed into compressive stresses.

The web heating is preferably performed inductively by means of induction coils adapted to the rail sections to be heated, but it may also be operated by means of a burner. Depending on the capacity of the heating apparatus and on the conveying speed of the rails in the roller straightener, the temperature gradient between the web portion on one hand and the head and base portions on the other hand, may be obtained in one step or in several steps during the feed-in into the roller straightener and also during the straightening operation. Through a modification of the heated rail section, internal stresses may be more or less decomposed or transformed into compressive stresses. Compressive stresses occur when in addition to the web portion the lower area of the rail head and the upper arm of the rail base are also heated.

The efficiency of the alternative inventive process may be demonstrated by the example of a high-resistance self-hardening UIC 60 rail, grade S 1200, having a tensile strength of 1,250 N/mm$^2$. The rail had the following chemical composition (% by weight): 0.75% of C, 0.72% of Si, 1.1% of Mn, 0.95% of Cr, 0.11% of V, 0.018% of S, 0.017% of P, 0.025% of Al.

During normal straightening there occur on the tread surface and at the lower face of the base portion longitudinal tension stresses of about 250 to 260 N/mm$^2$. During straightening of a web portion heated to 300° C., the longitudinal tension stresses are reduced to values of less than 50 N/mm$^2$.

The alternative inventive process may also be used for decomposing internal stresses of rolled steel sections comprising a web portion and head and/or base portions vertically extending thereto, such as T-beams or double T-beams or the like.

Hereafter the alternatively suggested solution is explained in detail by means of drawings.

Figure 4:
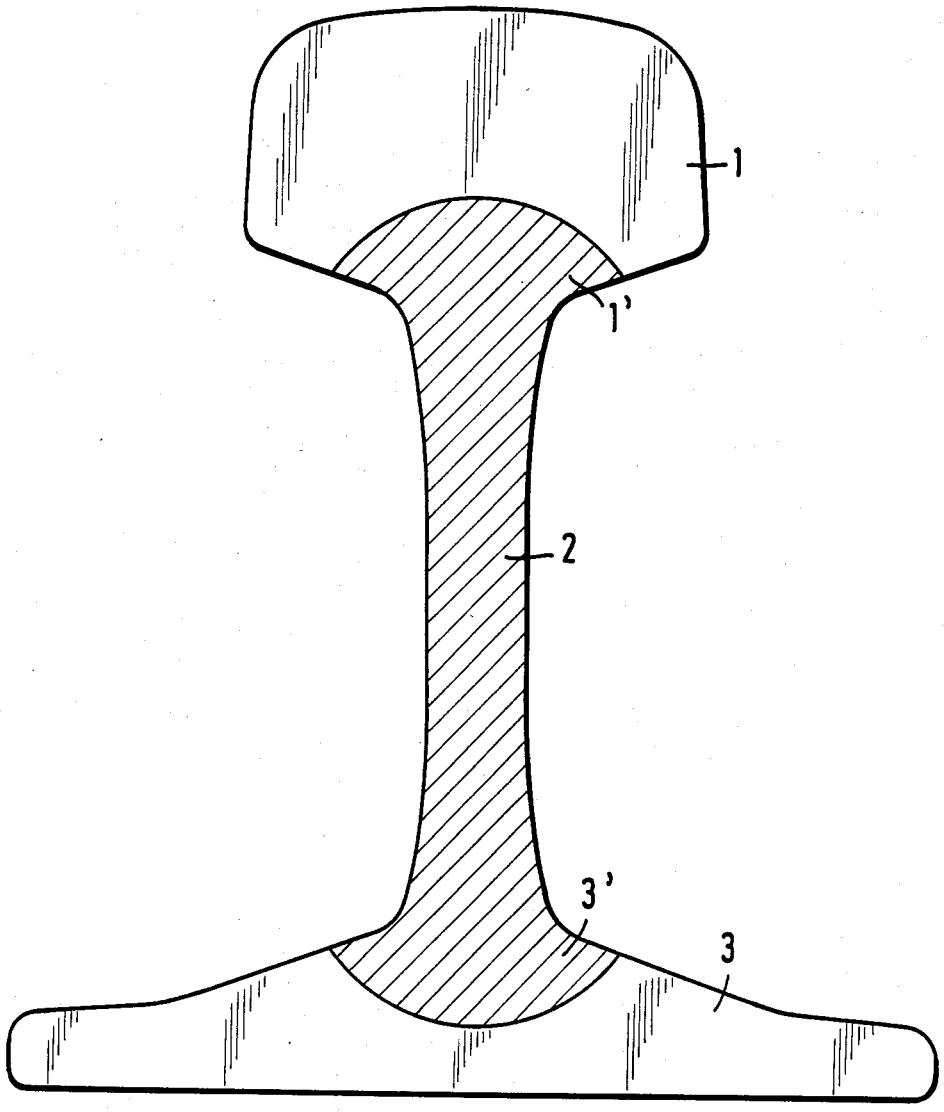
FIG. 4 is an elevational view of a UIC 60 rail section.

FIG.4 shows in scaled representation a UIC 60 rail section comprising a head portion 1, a web portion 2 and a base portion 3. For the execution of the inventive process it is recommended to heat not only web portion 2 but also other sections, such as the lower area 1' of rail head 1 at the transition to web portion 2, and the upper area 3' of rail base 3 at the transition to web portion 2.

Figure 5:
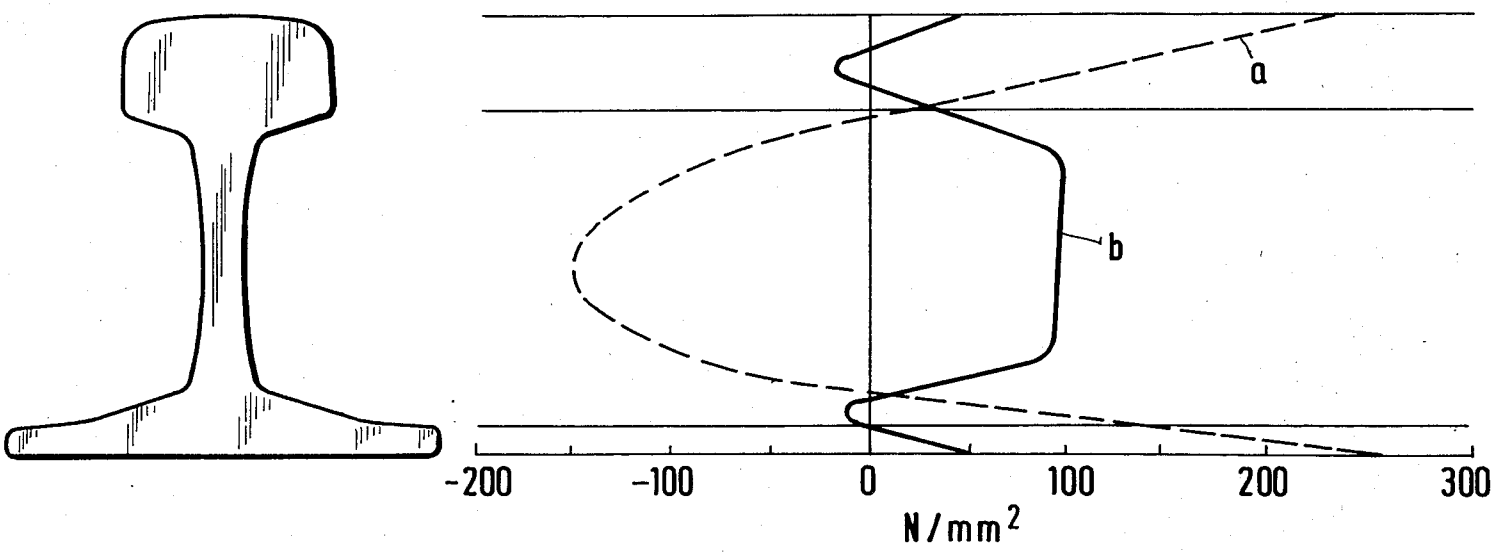
FIG. 5 depicts the rail section in FIG. 4 with a corresponding profile of tensile strength for two straightening operations represented by curves "a" and "b".

The improvement of the internal stress conditions in the rail section is shown in FIG. 5. During normal straightening there has been obtained in the inspected self-hardening rail having a tensile strength of 1,250 N/mm$^2$ a curve "a" with high internal tension stresses in the head and base portions. During straightening with web portion heating to 300° C., there has been obtained the much more favourable curve "b".

The improvement of the operational behaviour of the rail may be demonstrated by means of fatigue tests causing fatigue cracks in rail base 3. Under an external load of 200 N/mm$^2$ the normally straightened rail broke with a fatigue crack having a depth of $c=1.7$ mm (FIG. 6).

Figure 7:
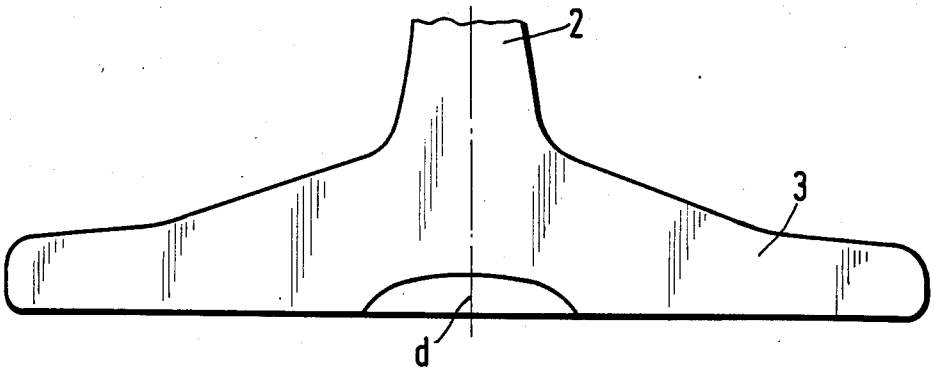

In the low stress rail treated according to the inventive process, the acceptable crack depth was increased to $d=7$ mm (FIG. 7).

Figure 6:
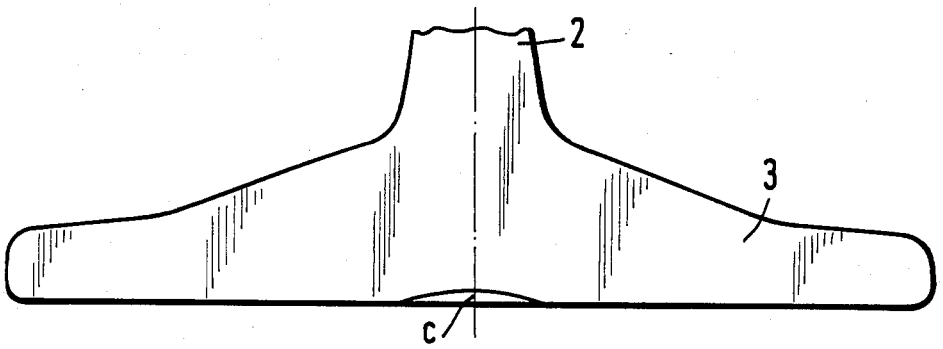
FIG. 6 and FIG. 7 are partial elevational views of rail sections showing the result of fatigue tests.

FIG. 6 and FIG. 7 are scaled representations.

Since surface flaws of this depth never or rarely occur in rails, there is also ensured for rails straightened with low stresses according to the alternative inventive process an essential improvement of rupture strength.

Figure 8:
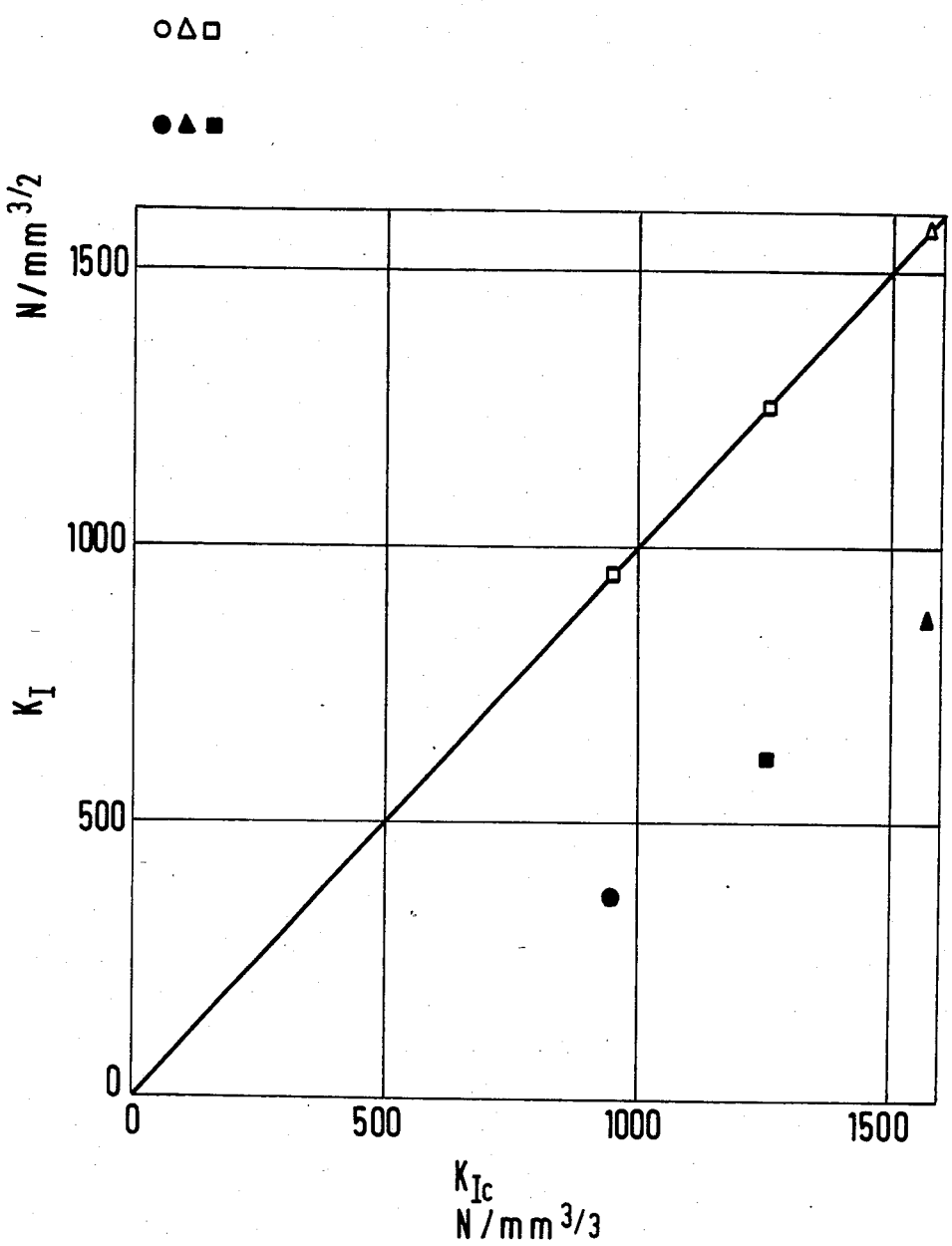
FIG. 8 is a graph of crack resistance of a rail component versus crack resistance of the rail steel.

In FIG. 8 the crack resistance $K_I$ of the rail component is plotted—in compliance with the explanations given with respect to FIG. 13—above the crack resistance $K_{Ic}$ of the rail steel. The critical $K_I$-value represents a reference for the rupture strength of the rail. Also for the rail free of internal stresses treated according to the alternative inventive process these values are grouped around the 45° line. However, for rails comprising internal stresses, the critical $K_I$-value clearly ranges below this line. Consequently, the rupture strength of the rail straightened according to the invention is substantially higher than that of normally straightened rails.

By the decomposition of internal stresses is also improved the fatigue strength of the rail component as carrier, i.e. the form stability which represents a reference for the resistance of a component under dynamic loads. The improvement of form stability ranges between 10 and 20%.

The rails treated according to the invention and presenting low internal stresses may be advantageously used for the following purposes:

without changing the existing operational conditions (unchanged rail strength, unchanged rail section, unchanged axle load) there is obtained improved rupture strength and service life (form stability) of the rail;

by maintaining the rupture strength there may be increased with unchanged rail section and unchanged rail strength the loads, i.e. the axle loads.

We claim:

1. A method of heat treating for reducing internal stresses in the head and base portions of roller straightened rails, said rails having a web portion, the method comprising annealing the straightened rail in a temperature range of about 200° C. to 700° C. by continuously conveying the rail in front of a heating apparatus at a speed adapted to the capacity of the heating apparatus, said speed ranging between 0.2 m/minute and 1 m/s, wherein during said conveying, heating only the web portions of the rails to the annealing temperature, and after reaching said annealing temperature, cooling the rails at room temperature.

2. A method according to claim 1, wherein the annealing temperature is 250° C. to 500° C.

3. A method for the production of roller straightened steel rails having low internal stresses, the rails having a web portion, the method comprising subjecting the rails to hot rolling, cooling the rails to a temperature of less than 100° C., continuously heating only the web portions of the rails to about 100° C. to 500° C., directing the rails to a roller straightening machine, straightening the rails, and cooling the rails by air to room temperature.

4. Method according to claim 3, wherein the web portion of the rail is heated to a temperature ranging between 150° and 350° C.

5. Method according to claim 3, wherein the rail web portion, the lower area of the rail head and the upper area of the rail base are heated.

6. A method according to claim 3, wherein the heating is conducted at 150° C. to 350° C.

* * * * *